US005960947A

United States Patent [19]

Dimelis et al.

[11] Patent Number: 5,960,947

[45] **Date of Patent: *Oct. 5, 1999**

[54] SAMPLE DISPLAY DEVICE

[75] Inventors: Dino A. Dimelis, Saline, Mich.; Georg Baratta-Dragono, Vienna, Austria; Lucinda A. Vejar, Danville; Larry F. Morice, San Ramon, both of Calif.

[73] Assignee: The Clorox Company, Oakland, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/673,520

[22] Filed: Jul. 1, 1996

[51] Int. Cl.[6] ..... B65D 23/14

[52] U.S. Cl. ..... 206/216; 206/460; 206/730; 206/806; 215/386

[58] Field of Search ..... 206/216, 460, 206/813, 806, 730–735; 383/11, 86; 248/205.3, 311.2; 220/476, 481; 215/386

[56] References Cited

U.S. PATENT DOCUMENTS

| | | | |
|---|---|---|---|
| D. 297,248 | 8/1988 | Barr . | |
| D. 337,620 | 7/1993 | Ponsi et al. . | |
| D. 352,526 | 11/1994 | Liebman . | |
| 2,363,418 | 11/1944 | Hosmer . | |
| 2,755,576 | 7/1956 | Golden | 206/813 |
| 2,861,735 | 11/1958 | Faltin | 206/806 |
| 3,133,690 | 5/1964 | Lui | 383/11 |
| 3,149,431 | 9/1964 | Blish . | |
| 3,184,051 | 5/1965 | Winton | 206/806 |
| 3,350,045 | 10/1967 | Mayers | 248/205.3 |
| 3,423,861 | 1/1969 | Forsyth . | |
| 4,016,977 | 4/1977 | Krautsack | 206/806 |
| 4,152,851 | 5/1979 | Goldstein | 206/813 |
| 4,208,819 | 6/1980 | Jones et al. . | |
| 4,546,943 | 10/1985 | Fast | 248/205.3 |
| 4,966,476 | 10/1990 | Kuzuya et al. | 400/208 |
| 5,048,711 | 9/1991 | Weiss et al. . | |
| 5,289,650 | 3/1994 | Follett et al. . | |
| 5,362,561 | 11/1994 | Lower . | |
| 5,390,435 | 2/1995 | Grody . | |

OTHER PUBLICATIONS

Do–It Hang–Tite™ 203A Brand Adhesive (Undated).

"Hang Tabs —More Ways to Hang More Products Effectively —Do–It Hang Tabs, etc.".

*Primary Examiner*—Paul T. Sewell
*Assistant Examiner*—Luan K. Bui
*Attorney, Agent, or Firm*—Joel J. Hayashida; Michael J. Bradley

[57] ABSTRACT

A display device for affixing samples to a package provides a member having a first surface which includes first fastening means; and a second surface which includes second fastening means, wherein the first fastening means fastens the member to a first object which supports the member, and the second fastening means attaches a display means.

4 Claims, 3 Drawing Sheets

SAMPLE DISPLAY DEVICE

BACKGROUND OF THE INVENTION

1. Field of the Invention

The invention provides a sample display device for attaching promotional items to consumer goods in a manner which does not obscure the label, or other graphical displays, on the packaging for such consumer goods.

2. Brief Statement of the Related Art

Promotional materials, such as free samples, are effective to promote new, or related consumer products in the manufacturer's product portfolio. As an example, a glass cleaner manufacturer could attach a small sample pouch of a new liquid dishwashing detergent the manufacturer wants to promote or introduce.

Prior ways of attaching or fastening samples to consumer product packaging, for example, bottles or other containers, usually involve paper yokes or elastic or corded loops, which typically merely suspended the sample from the finish, or neck, of the bottle. These prior art methods are disadvantageous for a number of reasons. First, a paper yoke is likely to be torn or otherwise damaged during transport. These samples could be added on at the point of display, but, to do so adds a work step to the merchant displaying such goods.

Further, using a thin, elastic or corded material to affix the sample, can result in deformation of the packaging for consumer goods. For example, a tightly bound elastic cord around the middle of a bottle made of thermoplastic material can cause warpage to said bottle.

Finally, regardless of whether paper or elastic material is used to suspend the sample, there is the final disadvantage in which the suspension of such sample typically obscures the label, or other packaging graphics of the packaged goods, resulting in a dissatisfactory presentation to the consumer at the point of display. Further, because the sample may be a new product, by its obscuring the label of the established consumer product, the hoped-for association with the established product is substantially mitigated. Thus, the physical problems caused by these prior display devices pale in comparison with the potential negation of the critical identification, or association, of the new product sample with the established product. This thus may lead not only to a failure to establish the new product's identity to the consumer, but also harm the established product's presentation to the consumer.

Among the examples of prior references which have affixed samples, or other promotional display items, or coupons, are Lower, U.S. Pat. No. 5,362,561, Jones, et al., U.S. Pat. No. 4,208,819, Grody, U.S. Pat. No. 5,390,435, Blish, U.S. Pat. No. 3,149,431, Follett et al., U.S. Pat. No. 5,289,650 and Forsyth, U.S. Pat. No. 3,423,861.

Unfortunately, none of these prior inventions overcomes any of the drawbacks associated with using paper yokes or elastic means for suspending samples from packaged goods.

SUMMARY OF THE INVENTION AND OBJECTIVES

The invention provides a display device comprising a member having a first surface which includes first fastening means; and a second surface which includes second fastening means; wherein said first fastening means fasten said member to a first object which supports said member, and said second fastening means attaches a display means.

Preferably, the first object is a packaged, consumer good, such as a bottle or other container. Further, the display means is typically a sample, or other promotional item.

It is therefore an object of this invention to attach or affix a sample from a packaged, consumer good without obscuring the package's label, or other graphical display.

It is another object of this invention to provide a sample display means which resists separation from the packaged, consumer good during preparation, storage, transport and/or display.

It is a further object of this invention to provide a sample display means which is removably affixed to a packaged, consumer good.

It is yet another object of this invention to provide a sample display which allows the easy and effective co-promotion of the sample with the more established, packaged consumer good to which it is affixed.

It is a still further object of this invention to affix samples, or other promotional materials, to packages for consumer goods in a cost effective yet durable manner.

DETAILED DESCRIPTION OF THE INVENTION

As stated in the foregoing discussion, providing an effective sample display device which attaches or fastens a sample to a package for consumer goods has proven to be quite problematic. While the ordinary solution is to suspend the sample from the package, i.e., a bottle or container, by a paper yoke or string or elastic cord, as has been discussed above, these particular solutions result in further problems including too easy separation or damage of the sample from the package, damage to the package itself by the material used to suspend, and, most critically, obscuring of the package label or other associated graphical display.

This invention presents an effective solution to these problems by providing a display device having a first surface with first fastening means and a second surface having second fastening means, the first fastening means attaching the member to a first object, namely, a package for consumer goods, and the second fastening means attaching the display means, or sample.

Figure 1:
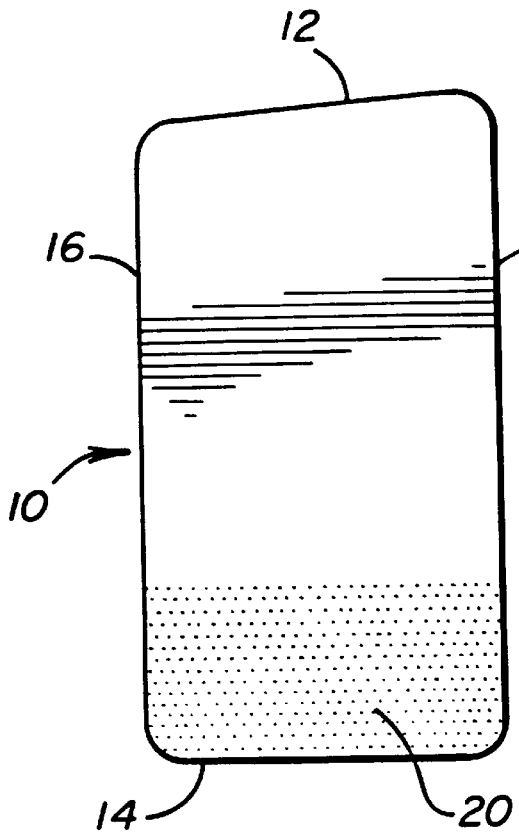
FIG. 1 is a plan view of the sample display device of the invention.
Figure 2:
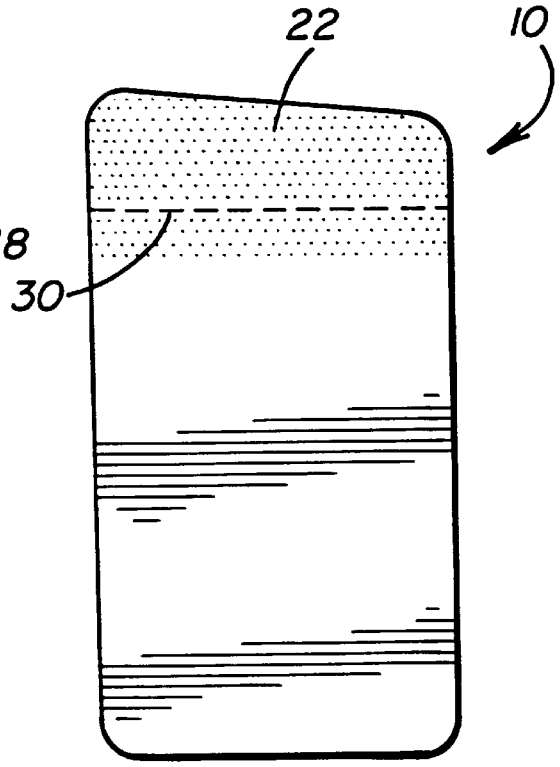
FIG. 2 is a bottom view of the sample display device of the invention.

FIG. 1 depicts the sample display device of the invention. The device comprises a member 10 having an upper depending end 12 and a lower depending end 14, as well as depending sides 16 and 18. On one surface X of member 10 is provided an adhesive means 20. In FIG. 2, which depicts the reverse side, or surface, Y, of member 10, there is provided at end 12 a further adhesive means 22. Also, contiguous with, or below the adhesive means 22 is score line 30. In practice, score line 30 may also be an indent or groove or other depression which allows portion 40 of member 10 to be bent or flexed.

Figure 3:
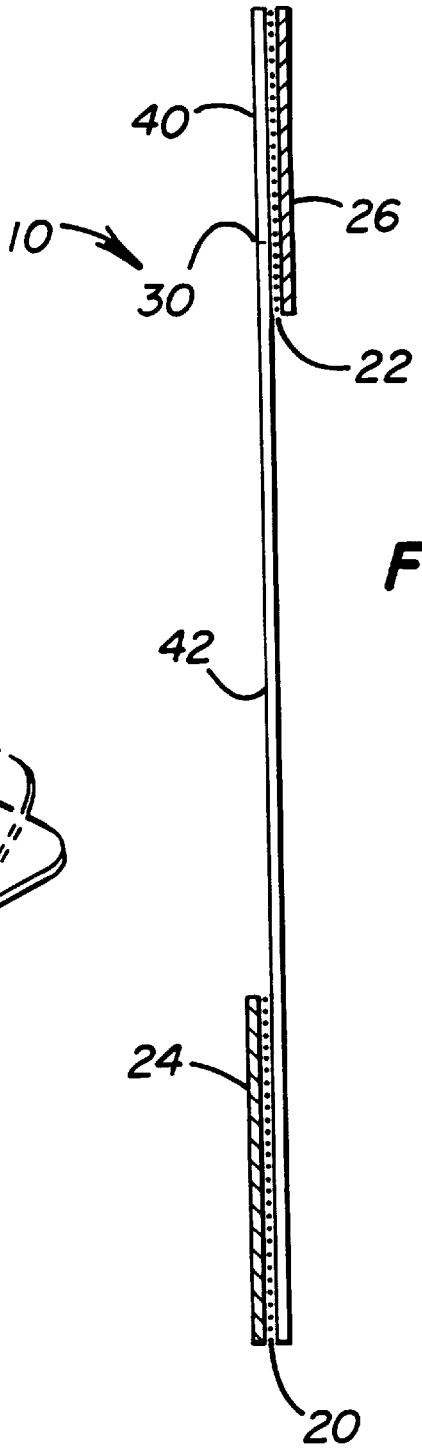
FIG. 3 is a side view of the sample display device of FIG. 2.
Figure 4:
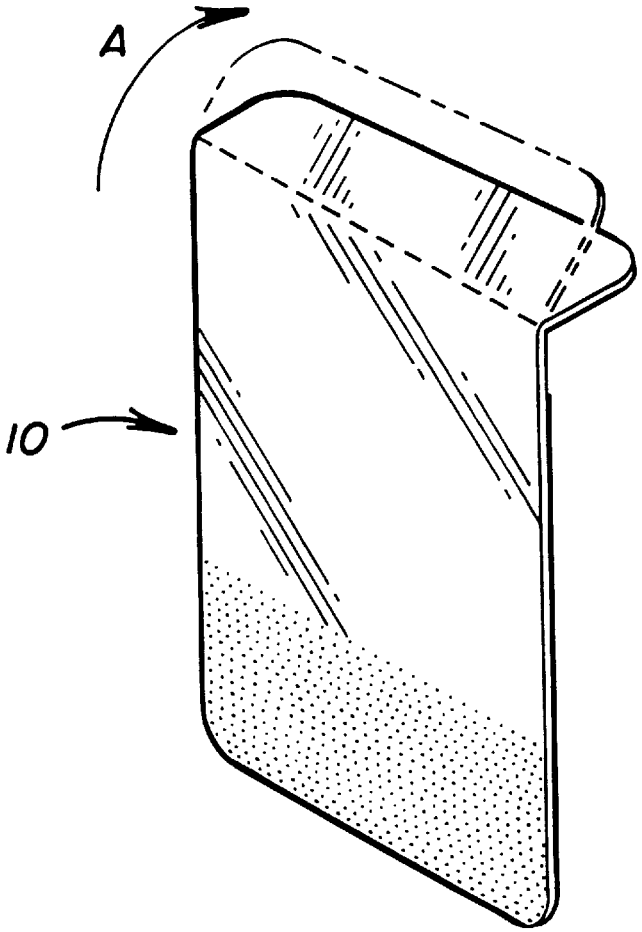
FIG. 4 is a perspective view of the sample display device in which portion 40 is bent or swung in direction A.

FIG. 3 depicts a side view of the sample display device of FIG. 2. Here, the adhesive means, or surfaces, 20 and 22 are shown with respective coated liners 24, 26. Obviously, the member 10 can be manufactured easily by stamping or die-cutting, and by having adhesive sprayed, coated, or otherwise deposited on member 10. Although, as depicted in these drawings, the adhesive surfaces 22 and 24 are preferably on opposed surfaces of member 10, in the practice of the invention, they may be on the same surface of member 10, although, preferably, at opposed ends. As previously mentioned, portion 40 preferably forms a top portion of the sample display device when portion 40 is bent or flexed acutely in a direction designated as A in FIG. 4. The angle, θ, which is formed between portion 40 and the rest of the body of member 10 forms an angle which is preferably less than 180°, more preferably less than 120°, and most preferably at least 90°.

Figure 5:
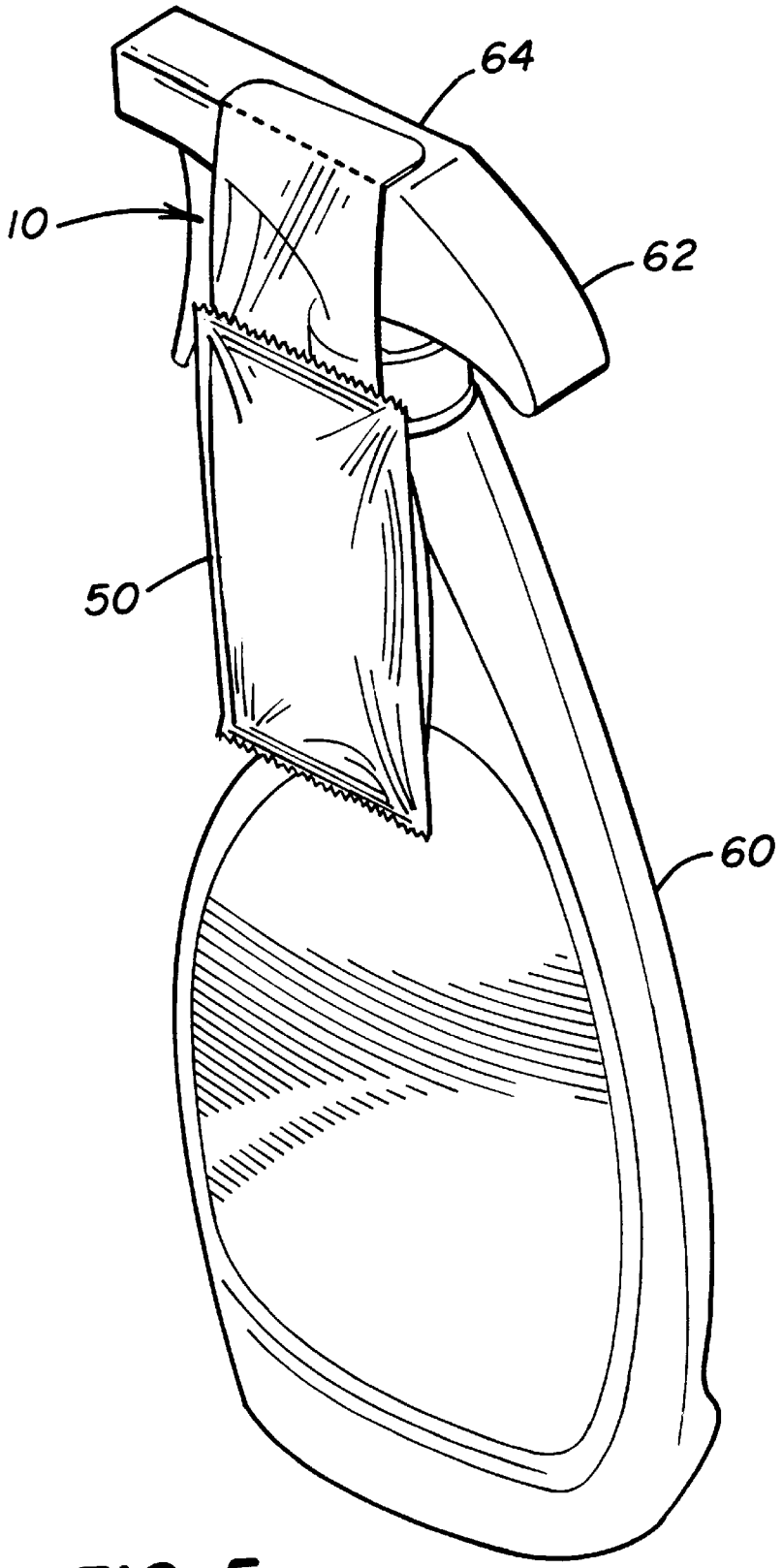
FIG. 5 is a perspective view of the sample display device affixing a product sample to a bottle for a liquid consumer product.

Bent, at this particular angle, the portion 40 via adhesive means 22 can be affixed to, e.g., the top surface 64 of a trigger head 62 of a bottle 60. As depicted in FIG. 5, bottle 60 is a container for a liquid consumer product. However, the invention is not limited to that particular type of goods, nor to this particular type of bottle or container for consumer goods. Finally, the exposed adhesive surface 20 on lower portion 42 of the sample display member 10 affixes a small sample pouch 50, for example, a small package made of heat sealed polyethylene, Mylar, or other suitable, flexible plastic.

As depicted in FIG. 5, the display is suitably suspended above the packaged consumer good, and effectively displays the sample pouch 50 while not obscuring the label, or other graphical display, of the container 60. As previously mentioned, the product sample is typically of a new, or related product, while the consumer good container is typically that of an established product. By allowing the co-promotion of the sample and the packaged, consumer good, an effective association is presented to the consumer in a merchandising technique known as a joint promotion.

The adhesive, or fastening means, 20, 22, is preferably a pressure sensitive, or contact sensitive, adhesive. The preferred adhesive is Hang-Tite™ 203A brand adhesive from Do-It Corporation. The adhesive is a high performance rubber base, and has a relatively high peel strength of 1,313 Newtons/Meter and a relatively high shear strength of +166 (hours). Other types of pressure sensitive adhesives, such as polyvinyl alcohol, polyvinyl acetate, rubber cement, and the like (See, for example, Kirk-Othmer Encyclopedia of Chemical Technology, Vol. 1, "Adhesives," 4th Ed., pp. 459–461 (1992), which are incorporated by reference herein), which are not permanently bonding, yet which resist separation by incidental contact, are suitable for use in the invention. Further, the inventive display device using an adhesive fastener is very advantageous in facilitating a very quick and efficient method to attach samples to packaged products versus prior methods.

The member 10 is preferably a clear, polyethylene terephthalate (PET) strip which is relatively thin (0.2–1.0 mil most preferably about 0.5 mil), elongate, e.g., about 2–15 centimeters (0.75–6 inches). The portion 40 which contacts the top surface of the packaged consumer goods, can vary in length, but preferably has a suitable surface area sufficient to maintain firm contact with such top surface. Thus, the length of such surface area of portion 40 can vary between about 0.6–2.5 centimeters (¼–1 inch). Although, in the invention, the top surface 64 of the container 60 is planar, or flat, the invention is not restricted to such surface, since it is only necessary that the portion 40 of the display device conform and contact such top surface 64 at a number of points sufficient to sustain such contact. Further, the sample display device can be made of other materials, such as polyvinyl chloride, polyvinylidene chloride, polyethylene, polypropylene, polycarbonate, and other materials known to those skilled in the art, whether transparent, translucent, or opaque. Further, end 12 is depicted as angled at about 30° with respect to score line 30, and this angle can vary so as to maximize surface area contact between portion 40 and surface 64 and to maintain proper registry between portion 42 and the longest perpendicular axis of the package 60, and, of course, to ensure that the sample 50 is held away from the body of package 60 at a proper distance and in registry, or alignment, with said package 60. Also, end 12 need not be cut at an angle, and instead, score line 30 can be angled, again, so as to maintain proper registry between portion 42, package 60 and sample 50.

These and other advantages and embodiments of the invention are captured in the claims which follow hereto.

We claim:

1. A combined display device and container comprising:

a container having at least one surface;

a transparent member having a first surface with a first discrete adhesive attachment means and a second surface with a second discrete adhesive attachment means;

a sample display means having at least one surface;

wherein said first surface of said member is attached to said surface of said container and said second surface of said member is attached to said surface of said sample display means, the first and second surfaces being opposed to one another and the first and second attachment means being at opposed ends of said member.

2. The combined display device and container of claim 1 wherein said member is a relatively thin, elongate member.

3. The combined display device and container of claim 2 wherein said container further includes a label area.

4. The combined display device and container of claim 3 wherein said member suspends and displays said sample display means away from the said label area.

* * * * *